United States Patent [19]

Grandclement

[11] 4,307,914

[45] Dec. 29, 1981

[54] SEAT FOR TERRACES IN A STADIUM OR THE LIKE

[75] Inventor: Charly Grandclement, Oyonnax, France

[73] Assignee: Grosfillex S.A.R.L., Arbent, France

[21] Appl. No.: 66,028

[22] Filed: Aug. 13, 1979

[30] Foreign Application Priority Data

Aug. 30, 1978 [FR] France ..... 78 25062

[51] Int. Cl.[3] ..... A47C 7/16

[52] U.S. Cl. ..... 297/458; 52/8; 297/232; 297/248; 297/DIG. 2

[58] Field of Search ..... 297/458, 248, DIG. 2, 297/232, 252, 250, 461, 218, 452; 52/6, 8

[56] References Cited

U.S. PATENT DOCUMENTS

| | | | |
|---|---|---|---|
| 2,588,417 | 3/1952 | Schladermundt et al. | 297/DIG. 2 |
| 2,711,786 | 6/1955 | Weiss | 297/DIG. 2 |
| 3,031,227 | 4/1962 | Van Buren, Jr. | 297/DIG. 2 |
| 3,194,601 | 7/1965 | Hoven et al. | 297/248 X |
| 3,441,315 | 4/1969 | Paes et al. | 297/458 |
| 3,466,087 | 9/1969 | Motter | 297/232 |
| 3,482,874 | 12/1969 | Henebry et al. | 297/458 |
| 3,531,157 | 9/1970 | Duckett et al. | 297/248 |
| 3,554,142 | 1/1971 | Sorenson et al. | 297/248 |
| 3,657,854 | 4/1972 | Tipton | 52/8 X |
| 3,749,442 | 7/1973 | Berg | 297/458 |
| 3,754,788 | 8/1973 | Martini | 297/248 X |
| 3,989,299 | 11/1976 | De Long | 52/8 X |
| 4,244,621 | 1/1981 | Lazaroff | 297/218 |

FOREIGN PATENT DOCUMENTS

| | | | |
|---|---|---|---|
| 1520176 | 3/1968 | France . | |
| 684821 | 12/1952 | United Kingdom | 85/45 |

*Primary Examiner*—James T. McCall

*Attorney, Agent, or Firm*—Shenier & O'Connor

[57] ABSTRACT

The present invention relates to a seat for terraces in a stadium or the like, comprising, in its front part, a downwardly directed front edge, of which the rear face is perpendicular to the lower face of the seat to strictly follow the shape of the corresponding surfaces of the terrace, while, substantially at the center of the horizontal part of the seat, there is provided at least one reinforced orifice adapted to receive a screw for fixing the seat to the terrace, the screw being rendered inviolable by a cover. This seat may be used for equipping stonework terraces for stadiums, open-air theaters, various auditoriums.

7 Claims, 5 Drawing Figures

SEAT FOR TERRACES IN A STADIUM OR THE LIKE

The present invention relates to a seat for terraces in a stadium, theatre, auditorium, etc. . . . comprising a shell made of plastics material adapted to be fixed to such terraces made of masonry.

The geographical limits of the places allocated to the spectators must firstly be set so that said latter are comfortable and do not obstruct their neighbours, whilst ensuring an optimum occupation of the space available.

At the same time, the maximum comfort must be ensured for the whole duration of the entertainment or meeting, for each person seated, due precisely to the seat fixed to the terrace and setting the limits of the space allocated to this person.

In addition, any attempt to dismantle or remove the seats must be rendered impossible, so as to avoid their being stolen, damaged or used as missiles.

These seats must of course be of attractive appearance and, despite all the above-mentioned imperatives which are particularly restricting, they must be produced and installed at a moderate cost price.

Finally, it must be possible to assemble the seats on the terraces either when said terraces are constructed, or after a prolonged use thereof, without seats.

To attain these purposes and in accordance with the invention, each seat comprises, in its front part, a downwardly directed front edge of which the rear face is perpendicular to the lower face of the seat in order strictly to follow the shape of the corresponding surfaces of the terrace, whilst there is provided, substantially at the centre of the horizontal part of the seat at least one reinforced orifice adapted to receive a screw for fixing the seat to the terrace.

This fixing screw is rendered inviolable after assembly and, according to a preferred embodiment, the reinforced orifice is made in the bottom of a recess defined by the shell and this recess is obturated by a cover which prolongs the concave horizontal surface and conceals the fixing screw.

According to a particularly advantageous embodiment, the cover rests by its peripheral edge on a shoulder surrounding the recess, this cover having a hook projecting therein which cooperates with a tooth of the seat located on one side of the fixing screw to ensure the grip of the cover; said cover is immobilised by means of a locking member disposed on the other side of said screw, the visible part of this member being concealed by the number of the seat.

The invention will be more readily understood on reading the following description with reference to the accompanying drawings, in which.

Figure 1:
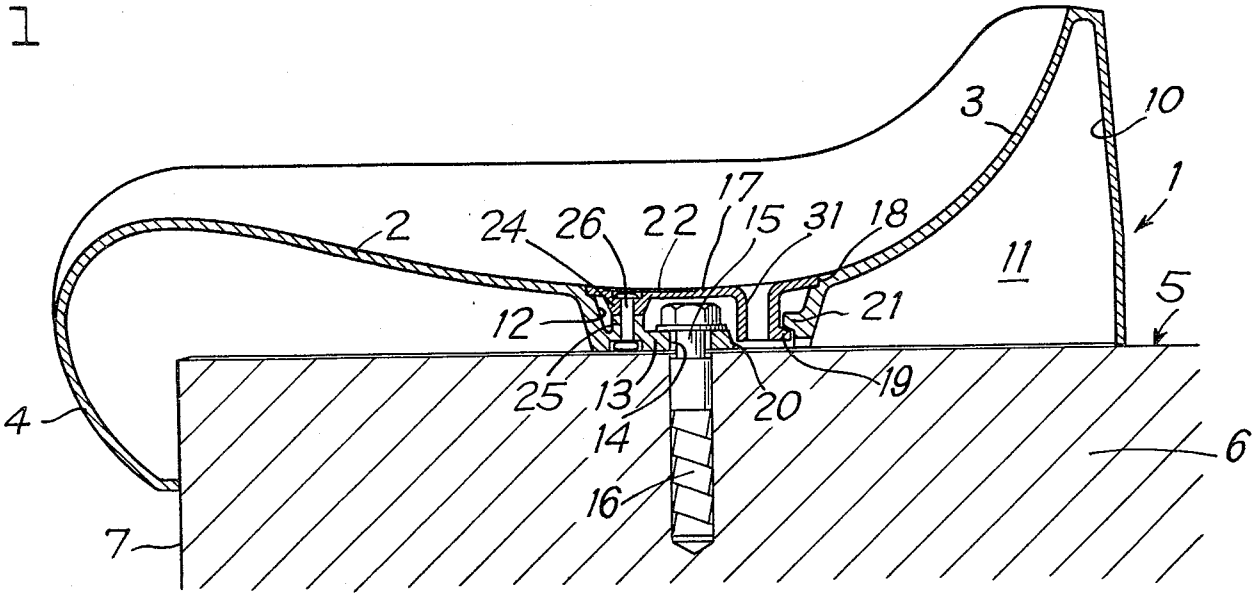
FIG. 1 is an antero-posterior section illustrating an embodiment of the seat according to the invention, mounted on a terrace and connected thereto by means of a first embodiment of the fixing device.
Figure 2:
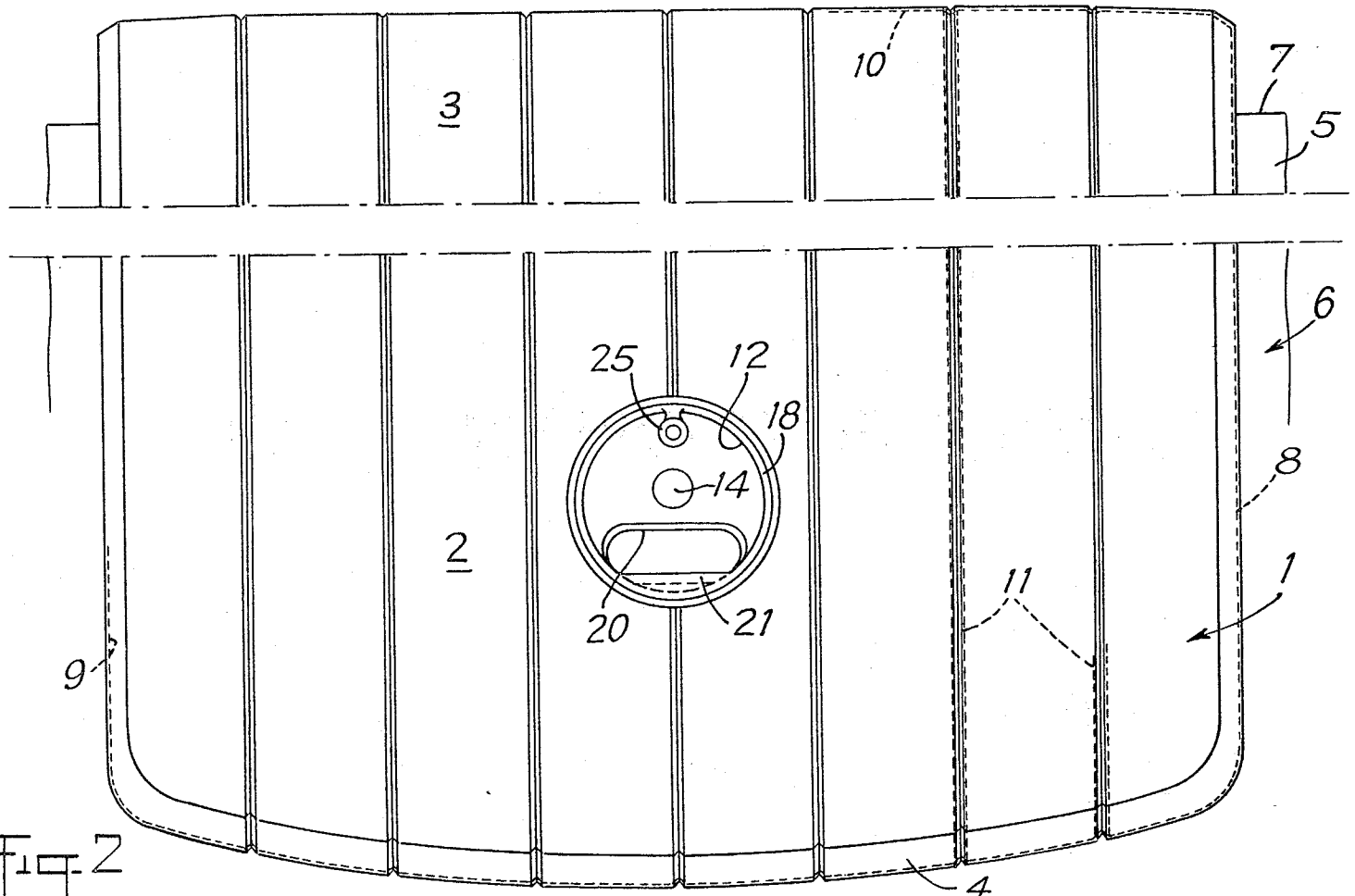
FIG. 2 is a plan view, from above, of this seat, of which the fixing device has been removed.

Referring now to the drawings, FIGS. 1 and 2 clearly show the seat which is a shell 1 made of plastics material having a substantially horizontal part 2, concave both in the antero-posterior direction and in the lateral direction perpendicular thereto.

This substantially horizontal part is extended rearwardly by a back 3 rising to a relatively low height and, forwardly, by an edge 4 in the form of a rim, descending below the substantially horizontal upper surface 5 of a terrace 6 and abutting against the substantially vertical front surface 7 of this terrace. This seat also comprises, cast therewith, two lateral walls 8 and 9 and a rear wall 10 which border the front edge 4, the substantially horizontal part 2 and the back 3 and continuously abut, like said front edge, on said surfaces 5 and 7 of the terrace.

In addition, it may comprise antero-posterior ribs 11 extending parallel to the lateral walls and projecting inside the shell, up to the front surface 7 of the terrace but arranging a slight clearance from the upper surface 5 of this terrace in order to allow a certain suppleness of deformation for the seat and the back when a person sits down.

Such a seat has no grip, due to its shape and as it is applied without clearance over the whole of its periphery against the terrace; consequently, it is impossible to grip the seat in an attempt to remove it, once it is fixed.

Moreover, concerning the fixation, it is important to note that the front edge 4 being applied over the whole of its length against the front vertical surface 7 or riser portion of the terrace, it suffices to press the shell at one point against the upper horizontal surface 5 of this terrace to ensure a rapid, simple and economic fixation of the seat.

The shell cooperates in this case with a fixing device which may be a single one, as is the case for the embodiment shown in FIGS. 1 and 2. However, it is obvious that a plurality of devices may be associated with the shell, it being understood that only one suffices and that the others may be eliminated without the efficiency of the fixation being affected.

According to this embodiment of FIGS. 1 and 2, the shell 1 defines, substantially at the centre of the horizontal part 2 thereof, a recess 12 of which the bottom 13, located near the upper surface 5 of the terrace, presents a reinforced orifice 14 adapted to receive a single fixing screw 15 of which the threaded part cooperates with a plug 16 positioned in said terrace.

This fixing screw 15 is rendered inviolable, by any suitable means, so that it is impossible for spectators to dismantle the seat.

Figure 3:
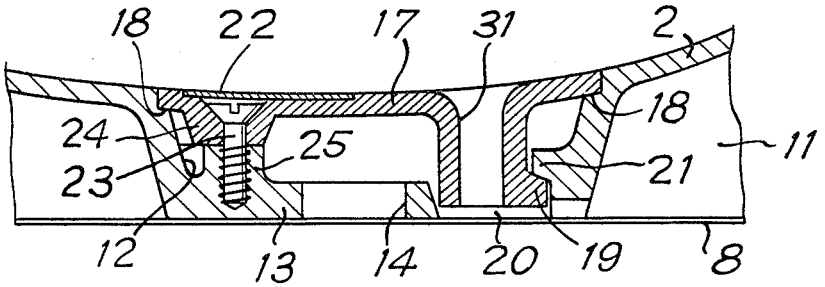
Figure 4:
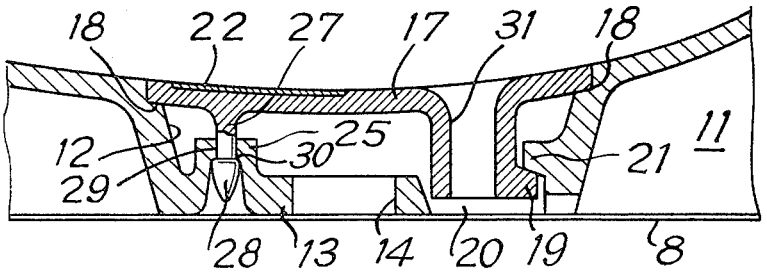

In the embodiment shown in FIGS. 1, 3 and 4, the recess 12 is obturated by a cover 17 which perfectly prolongs the visible concave surface of the horizontal part 2 and thus conceals the fixing screw 15. The cover 17 rests by its peripheral edge on a shoulder 18 made in this horizontal part about the recess 12. This cover 17 has, projecting therein, a hook 19 adapted to be engaged in an elongated opening 20 in the bottom 13 (FIG. 2) and to cooperate with a tooth 21 belonging to the rear wall of this recess in the horizontal part. Said cover 17 also comprises, opposite the hook with respect to the screw 15, i.e. near the front wall of the recess, a locking member cooperating with the bottom 13 and of which the visible part is concealed by a number of the seat 22 placed on this cover when the seat is installed.

According to the preferred embodiment shown in FIG. 3, the locking member is constituted by a screw 23 passing through a subjacent boss 24 of the cover 17 and cooperating, by its self-tapping threaded part, with a boss 25 with cruciform hole projecting from the bottom 13.

According to a second embodiment shown in FIG. 1, the locking member is a rivet 26 passing through said bosses 24 and 25, this rivet preferably being of the type to be placed from the outside, such as the one known under the name of Pop rivet.

According to a third embodiment illustrated in FIG. 4, the locking member operates by clipping and comprises a finger 27 with protuberant head 28 adapted to be forcibly engaged in a hole 29 in the boss 25, to retract therein and abut by elastic return at the opening of the hole, against a shoulder 30, taking its initial shape again.

Figure 5:
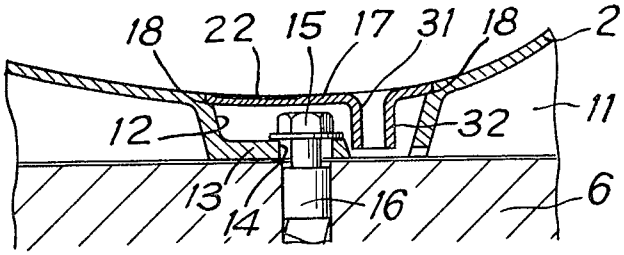
FIGS. 3 to 5 are partial sections on different scales showing three other embodiments of this fixing device.

In a fourth embodiment shown in FIG. 5, the hook and the locking member are eliminated and replaced by an agent for connecting the peripheral edge of the cover 17 with the shoulder 18; this connection may be obtained by gluing, welding or the like.

To avoid rain water accumulating in the dish defined by the substantially horizontal part 2 of the seat 1, an opening 31 is made either through the hook 19 (FIGS. 1, 3 and 4) or through a base 32 projecting under the cover (FIG. 5).

The invention is not limited either to the embodiment of the seat or to the embodiments of its fixation, as various modifications may be made thereto without departing from its scope.

This seat may be used for equipping stonework terraces for stadium, open-air theatres, various auditoriums, etc. . . .

I claim:

1. A seat adapted to be fixed to a terrace of a stadium or the like, said terrace having a generally horizontally extending portion and a riser portion at the front thereof, said seat comprising a plastic shell having a generally horizontal portion adapted to rest on the horizontal portion of said terrace and a downwardly directed front edge portion extending over a portion of said riser, said front edge portion having a rear face closely conforming to the configuration of the riser and adapted to engage said riser when said seat is fixed to inhibit rotary movement of said seat, said horizontal seat portion being formed with at least one generally centrally located reinforced orifice for receiving a screw for securing said seat to said terrace.

2. A seat as claimed in claim 1, wherein the fixing screw is rendered inaccessible after assembly.

3. A seat as claimed in claim 2, wherein the reinforced orifice is made in the bottom of a recess defined by the shell and this recess is obturated by a cover which forms a continuation of the concave, substantially horizontal surface to conceal the fixing screw.

4. A seat as claimed in claim 3, wherein the cover rests by its peripheral edge on a shoulder surrounding the recess, this cover presents, projecting therein, a hook which cooperates with a tooth of the seat located on one side of the fixing screw to ensure the grip of the cover and said cover is immobilised by means of a locking member disposed on the other side of said screw, the visible part of this member being concealed by the number of the seat.

5. A seat as claimed in claim 4, wherein the locking member is a screw.

6. A seat as claimed in claim 4, wherein the locking member is a rivet, preferably of the type to be placed from the outside.

7. A seat as claimed in claim 4, wherein the locking member is a finger with protuberant head, this finger projecting from the cover into the recess and cooperating, by elastic deformation, with an orifice made in the bottom of this recess.

* * * * *